US009783265B2

(12) United States Patent
Duncan

(10) Patent No.: US 9,783,265 B2
(45) Date of Patent: Oct. 10, 2017

(54) FOIL-ASSISTED CATAMARAN MARINE CRAFT

(71) Applicant: Ian James Duncan, Bedford (GB)

(72) Inventor: Ian James Duncan, Bedford (GB)

( * ) Notice: Subject to any disclaimer, the term of this patent is extended or adjusted under 35 U.S.C. 154(b) by 0 days.

(21) Appl. No.: 14/440,141

(22) PCT Filed: Nov. 4, 2013

(86) PCT No.: PCT/EP2013/072962

§ 371 (c)(1),
(2) Date: May 1, 2015

(87) PCT Pub. No.: WO2014/068121

PCT Pub. Date: May 8, 2014

(65) Prior Publication Data

US 2016/0229490 A1 Aug. 11, 2016

(30) Foreign Application Priority Data

Nov. 2, 2012 (GB) ..... 1219776.0

(51) Int. Cl.

| | |
|---|---|
| ***B63B 1/28*** | (2006.01) |
| ***B63B 1/26*** | (2006.01) |
| ***B63B 1/10*** | (2006.01) |
| ***B63B 1/12*** | (2006.01) |
| ***B63H 11/02*** | (2006.01) |
| *B63H 11/00* | (2006.01) |

(52) U.S. Cl.

CPC ..... *B63B 1/26* (2013.01); *B63B 1/10* (2013.01); *B63B 1/121* (2013.01); *B63B 1/286* (2013.01); *B63H 11/02* (2013.01); *B63H 2011/006* (2013.01)

(58) Field of Classification Search

CPC .. B63B 1/26; B63B 1/10; B63B 1/121; B63B 1/286

USPC ..... 114/271

See application file for complete search history.

(56) References Cited

U.S. PATENT DOCUMENTS

| | | | | |
|---|---|---|---|---|
| 3,139,059 | A * | 6/1964 | Hanford, Jr. | B63B 1/286 114/273 |
| 4,606,291 | A | 8/1986 | Hoppe | |
| 4,748,929 | A | 6/1988 | Payne | |
| 5,520,137 | A | 5/1996 | Arii et al. | |
| 6,164,235 | A * | 12/2000 | Hoppe | B63B 1/12 114/275 |

(Continued)

FOREIGN PATENT DOCUMENTS

| | | | |
|---|---|---|---|
| GB | 2341143 | A | 3/2000 |

OTHER PUBLICATIONS

International Preliminary Report on Patentability dated May 5, 2015 in Int'l. Application No. PCT/EP2013/072962.

(Continued)

*Primary Examiner* — Stephen P Avila
(74) *Attorney, Agent, or Firm* — Polsinelli PC

(57) ABSTRACT

A marine catamaran craft, comprising at least one forward hydrofoil fixed to each of the catamaran hulls and at least one rear hydrofoil in which:

At least one forward hydrofoil is arranged for shallowly submerged operation

At least one rear hydrofoil is arranged for shallowly submerged operation at low speeds and for planing operation at higher speeds A rear part of each of the catamaran hulls remains wetted at all speeds.

18 Claims, 8 Drawing Sheets

Hydrofoil-Assisted Symmetric-hulled Catamaran

(56) References Cited

U.S. PATENT DOCUMENTS

2005/0178310 A1* 8/2005 Loui ..... B63B 1/107
114/271

OTHER PUBLICATIONS

Patent Examination Report No. 1 dated Oct. 25, 2016 in corresponding Australian Patent Appln. No. 2013340748.

* cited by examiner

Hydrofoil-Assisted Symmetric-hulled Catamaran

Hydrofoil-Assisted Symmetric-hulled Catamaran

Hydrofoil-Assisted Symmetric-hulled Catamaran
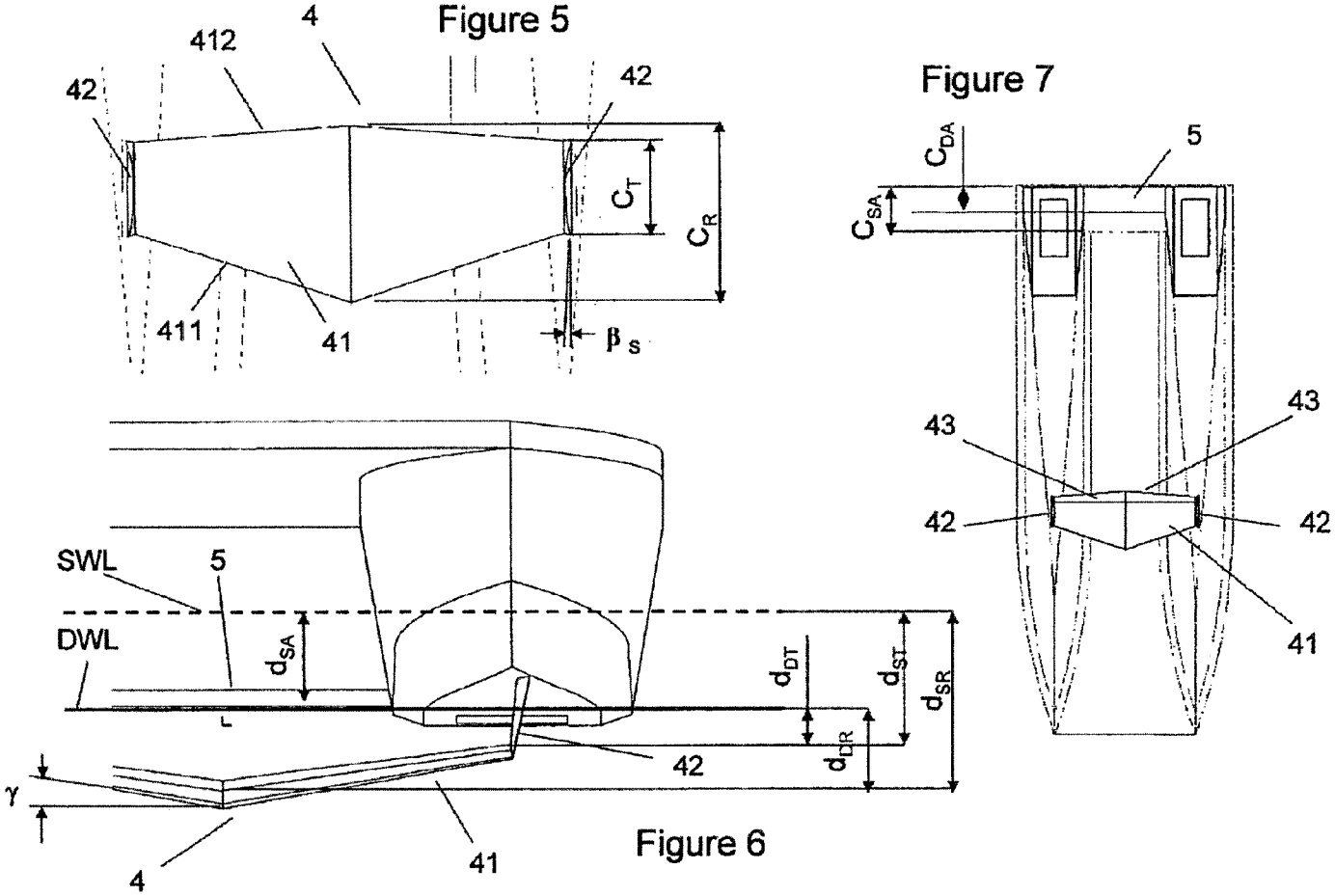

Rear Foil Profiles

Subcavitating & cavitating Sections close to free surface

L/D Variation with varying AR and camber

Resistance Reduction

Resistance Reduction

FOIL-ASSISTED CATAMARAN MARINE CRAFT

SUMMARY OF THE INVENTION

This invention relates to a new form of hydrofoil assistance for catamaran marine craft. The hydrofoils are configured such that they provide both high lift coefficients and high ratios of lift to drag over a wide range of craft speeds. The aft end of the catamaran hulls remain partially submerged to ensure proper operation of water jet or other propulsion systems such as surface drives, stern drives or the like.

The invention has particular application to the use of high speed catamarans and other surface craft powered by one more hydrojets with conventional water intakes situated in the lower hull surface towards the aft of the hull and which can benefit from the greatly reduced power consumption and improved ride and handling provided.

Whereas hydrofoils are conventionally applied to faster craft, the lift and drag characteristics of the new sections are such that significant reductions in hull resistance have been recorded at displacement Froude numbers as low as 1.0 such that the new sections also have application to relatively heavy commercial and workboats. The displacement Froude number $Fn\nabla$ is given by the following expression:

$$Fn\nabla = V/\sqrt{(g \cdot \Delta^{1/3})}$$

where V is the velocity of the craft, Δ is the volume of water displaced by the hull when it is at rest and g is the rate of acceleration due to gravity (all in consistent units)

Once fully foil-borne the lift to drag ratio increases steadily with speed such that the power requirement remains relatively constant over a wide speed range, essentially only increasing due to the increasing wind resistance.

Some prior art marine crafts incorporate deeply submerged foils and controllable flaps such devices add weight to the craft and create a high hump resistance. Additionally such devices need complex lifting mechanisms and safety devices.

Whilst a preferred embodiment involves the use of at least a front hydrofoil including controllable flaps, embodiments of the invention can provide a way of controlling the ride height and trim angle in relation to the speed of the marine craft without the use of movable devices.

Other prior art marine crafts incorporate shallowly submerged foils which start to ventilate at relatively low displacement Froude numbers such that the resistance tends to start increasing at moderate Froude numbers. Such craft tend also to have limited load capacity. In general such craft are also arranged with the centre of pressure only narrowly in front of the longitudinal centre of gravity and are very sensitive to centre of gravity changes. In this context the expression "shallowly submerged hydrofoil" means a hydrofoil which is designed to operate at a depth/chord ratio of less than one.

A number of prior art technologies have addressed the application of hydrofoil assistance as a means of reducing hull resistance. For instance EP0094673, EP0051073, U.S. Pat. No. 4,606,291, and WO2008007249 all describe versions of foil-assisted catamarans with narrowly-spaced asymmetrical demi-hulls, a forward foil carrying the predominant part of the craft weight with a centre of pressure narrowly ahead of the longitudinal centre of gravity and small aft trim foils some of which are wetted whilst others lift totally clear of the water surface. EP0352195 describes a foil-assisted catamaran with a relatively deeply immersed rear hydrofoil and forward planing surfaces. U.S. Pat. No. 5,520,137 describes a catamaran craft with shallowly submerged fixed forward and rear hydrofoils with forward controllable incidence foils amounted below the static water level and above the dynamic water level. U.S. Pat. No. 4,159,690 describes a hydrofoil craft with deeply immersed and controllable forward and rear hydrofoils.

The primary object of this invention is to provide means to enable a significant increase in top speed, cruising speed and cruising range with a reduction or at least no increase in power or fuel capacity It is a further object of this invention to provide means to enable efficient craft operation over a wide range of load and longitudinal centre of gravity variations It is a further object of this invention to provide means which can be simply retrofitted to existing hulls without the need for major structural or other modification Accordingly a catamaran craft is arranged with a forward hydrofoil system comprising at least one hydrofoil extending between the two hulls of the catamaran and a rear hydrofoil system comprising at least one rear hydrofoil. The front hydrofoil system is positioned such that its centre of pressure is forward of the most forward expected position of the longitudinal centre of gravity by a determined margin. This system comprises at least one hydrofoil designed for shallowly submerged operation which is preferentially positioned below the hull such that the forward end of the hull can be lifted clear of the water to reduce friction drag. The rear hydrofoil system comprises at least one hydrofoil arranged for shallow submergence at low speeds and for planing operation at design speeds such that the ride height of the rear of the craft remains substantially constant once foil-borne. The rear hydrofoil system is positioned above the transom height of the catamaran hulls such that a defined area of aft end of the hulls remains wetted such as to allow normal operation of waterjets or other conventional propulsion systems.

In a preferred embodiment the forward hydrofoils comprise controllable flaps to control the craft trim and roll attitude.

In a second preferred embodiment a rear foil comprises a flap which may be controllable or adjustable to improve the craft performance in the speed range about which the craft becomes foil-borne or to improve the maximum speed of the craft or both

BRIEF DESCRIPTION OF THE DRAWINGS

Preferred examples of a marine craft will now be described with reference to the accompanying drawings.

FIG. 5 shows a detailed view of a front hydrofoil;

FIG. 6 shows a partial detailed frontal view of a craft according to the present invention with the displacement and design waterline positions;

FIG. 7 shows a further underside view of a craft according to the present invention with a front foil fitted with flaps;

DETAILED DESCRIPTION

Figure 1:
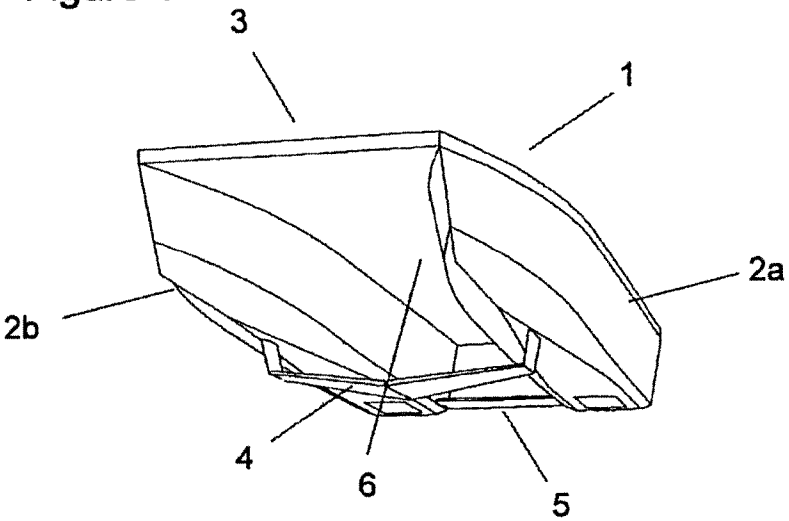
FIG. 1 shows an isometric view of a craft according to the present invention.
Figure 2:
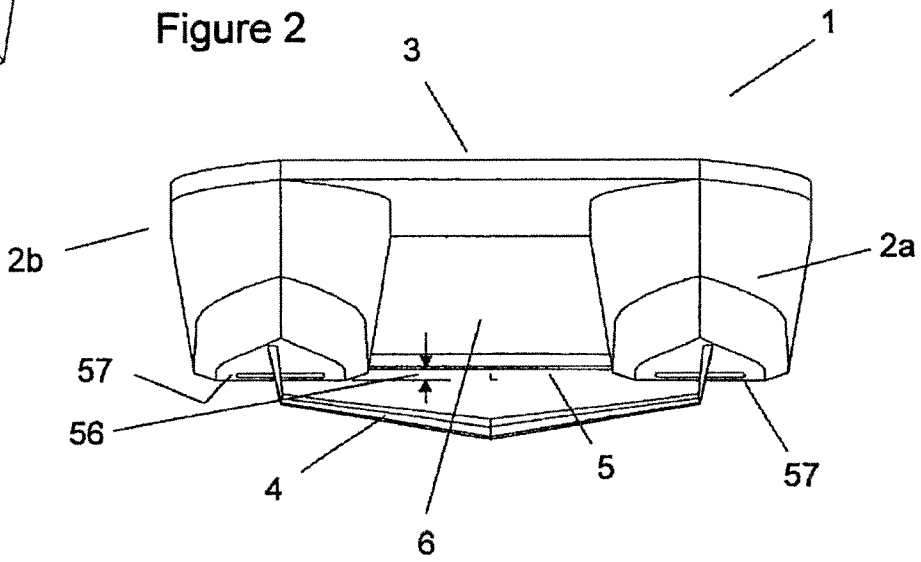
FIG. 2 shows a frontal view of a craft according to the present invention.

Referring to FIGS. 1 and 2 the catamaran craft 1 has two laterally separated hulls 21, 2*b* joined by a superstructure 3. A forward hydrofoil 4 is attached to a lower surface of each of the hulls 2*a*, 2*b* and a rear hydrofoil 5 is attached to the inner walls of the tunnel 6 such that its underside surface is aligned with, or preferably some distance 56 above the underside of the hulls 2*a*, 2*b*. A tunnel 6 is defined by the inner walls of the hulls 2*a*, 2*b* and the underside of the superstructure 3. Transom interceptors, flaps or wedges 57 may preferentially be fitted to increase the pressure on the underside of the hull which has the effect of increasing the aspect ratio of the rear foil 5.

Figure 3:
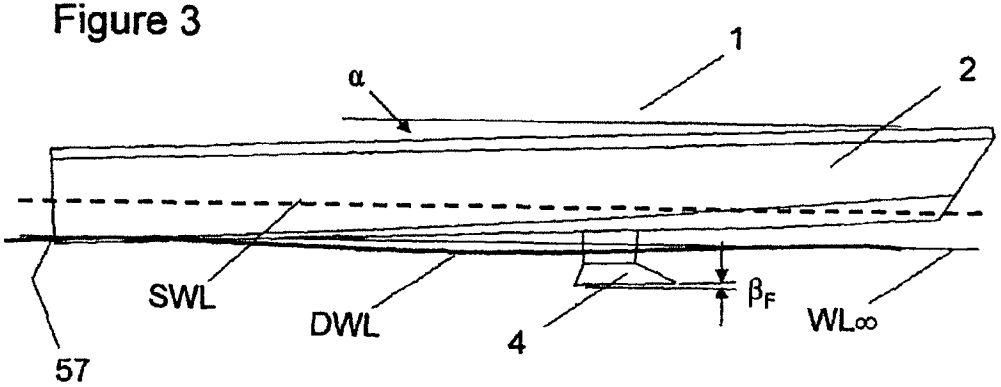
FIG. 3 shows a side view of a craft according to the present invention.

Referring to FIG. 3 showing a side view of craft 1, a line SWL indicates the level of the waterline when the craft is at rest or travelling slowly, a straight line WL∞ indicates the undisturbed water level when the craft is travelling at its design speed and a curved line DWL indicates the position of the water surface at the centreline of the craft at its design speed. At the design speed the adopts a trim angle $\alpha$ such that the aft end of the hulls 2 are lightly submerged whilst the forward end of the hulls 2 are above the water surface DWL. In this condition the lift generated by the front hydrofoil 4 governs the trim angle $\alpha$. The wetted area of hulls 2 is kept to a minimum commensurate with the requirements of the propulsion system by the arrangement of the height of the rear hydrofoil (56 of FIG. 2) and the hull trim angle $\alpha$ wherein $\alpha$ should preferentially be arranged within the range between 2 degrees and 3 degrees. Whilst the angle of attack $\beta_F$ of the front foil 4 at the design condition is not unduly critical it should preferentially be arranged to minimise drag in the design condition and will normally be arranged to be within the range of +/−2 deg.

Figure 4:
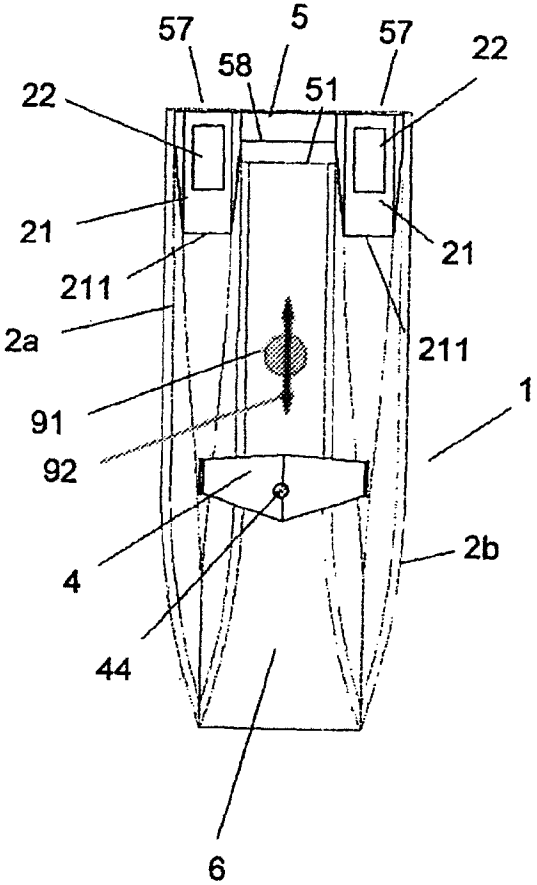
FIG. 4 shows an underside view of a craft according to the present invention in which the wetted areas at design speed are shown in bold.

Referring to FIG. 4 showing the underside of craft 1, the wetted surfaces in the design condition are shown in bold. A front hydrofoil 4 is arranged with a Centre of Pressure (CP) 44 forward of the most forward extend of the ranges of positions 92 of the Longitudinal Centre of Gravity 91 of the craft 1. Wetted surfaces 21 of the hulls 2*a*, 2*b* have spray root contact lines 211 with the water surface. In the case of hydrojet propulsion systems the intakes 22 are situated at a sufficient distance behind the spray root contact lines 211 as to prevent ventilation. The wetted surface of a rear hydrofoil 5 has a spray root edge 58 aft of the physical leading edge 51 of the hydrofoil such that wetted area is less than the physical area of the hydrofoil and the aspect ratio thereof is increased proportionally. The wetted areas 21 of hulls 2*a*, 2*b* and the wetted area of hydrofoil 5 form a continuous surface which has the effect of augmenting the performance of both the hull surface and the hydrofoil surface treated in isolation. At lower speeds when the rear foil 5 is immersed the side walls of tunnel 3 act as fences which also has the effect of increasing the effective aspect ratio of the foil lifting surface and by consequence its performance. Transom interceptors, flaps or wedges 57 may preferentially be fitted to increase the pressure acting on surfaces 21 which additionally has the effect of increasing the effective aspect ratio of hydrofoil 5.

Referring to FIGS. 5 and 6 a preferred planform of the front foil 4 is shown with a root chord $C_R$ and a tip chord $C_T$. More generally the hydrofoil may be arranged with constant chord or with other chord distribution such as with curved leading or trailing edges without effecting the generality of the present invention. The hydrofoil has a lifting surface 411 with a leading edge 411 and a trailing edge 412. Surface 411 may be horizontal but is preferentially arranged with a dihedral angle $\gamma$. Generally vertical struts 42 connect either end of the lifting surface 411 to the under surfaces of hulls 2*a*, 2*b*. Struts 42 act as winglets and serve to increase the effective aspect ratio of hydrofoil 4. The winglets may preferentially be arranged with a small angle of attack $\beta_S$ to provide an improved pressure distribution along the hydrofoil. It can be seen that under design conditions the struts cut the design water surface DWL which acts as a mirror plane and serves to substantially increase the effective aspect ratio of hydrofoil 4. At slower speeds the under surfaces of hull 2*a*, 2*b* act as an endplates which also serve to increase the effective aspect ratio of hydrofoil 4.

From FIG. 6 it can be seen that the immersion depth of the root section of hydrofoil 4 is $d_{DR}$ in the design condition and $d_{sR}$ in the static condition whilst the immersion depth of the tip section of hydrofoil 4 is $d_{DT}$ and $d_{ST}$ for the above conditions. Thus the immersion depths in chord terms are $d_{DR}/C_R$, $d_{SR}/C_R$ for the root section and $d_{DT}/C_T$, $d_{ST}/C_T$ for the tip section. These values are key factors in determining the lift and drag forces generated by the front hydrofoil 4. From FIG. 6 is can also be seen that the rear hydrofoil 5 is not immersed in the design condition, but is operating as a planing surface in this condition. Under static conditions the rear foil immersion is $d_{SA}$.

Referring to FIG. 7 a preferred arrangement in which the front foil 4 is equipped with port and starboard flaps 43 which may preferentially be operated independently such that differential flap displacement may provide a roll moment about the longitudinal axis of craft 1 and common displacement of flaps 43 serves to increase or decrease the lift generated. FIG. 7 also shows that under design conditions the rear foil chord is reduced from its static value of $C_{SA}$ to a value of $C_{DA}$. This reduction in effective chord has the effect of proportionally increasing the effective aspect ration of the rear hydrofoil 5 resulting in significantly improved lift and drag reduction.

Figure 8:
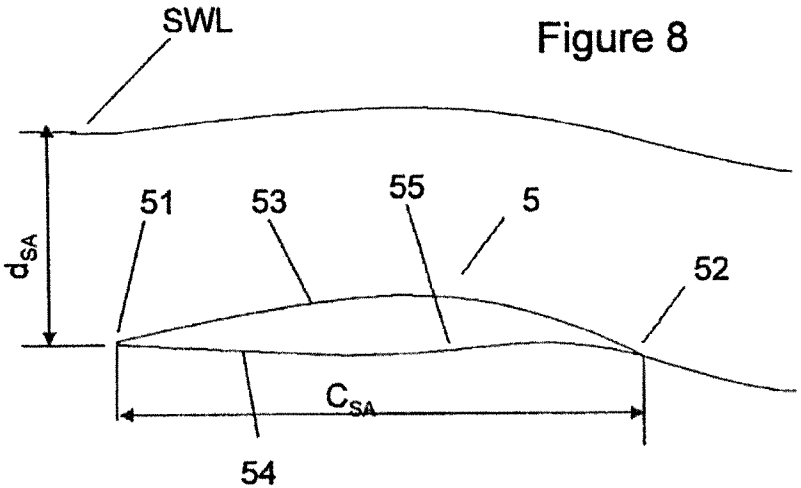
FIG. 8 shows a section through a rear hydrofoil of the present invention with an indication of its position relative to the water level at low speed.
Figure 10:
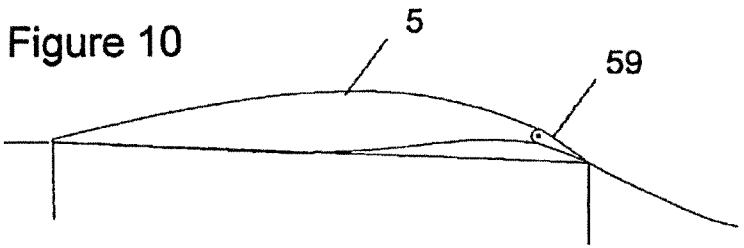
FIG. 10 shows a section through a rear hydrofoil fitted with a flap.
Figure 9:
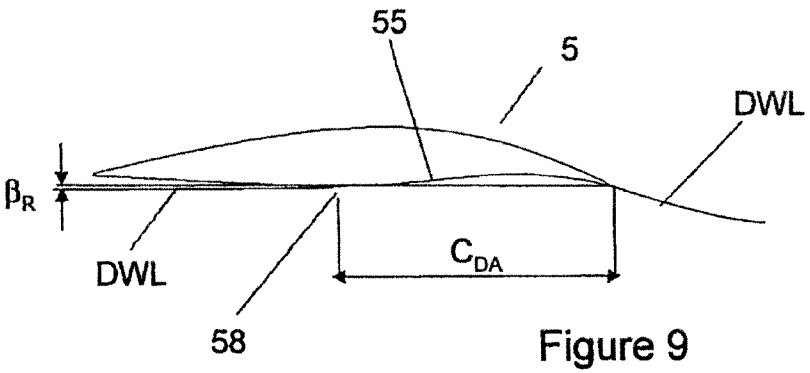
FIG. 9 shows a section through a rear hydrofoil of the present invention at design speed.

Referring to FIGS. 8, 9 and 10 the rear hydrofoil 5 has a leading edge 51 and a trailing edge 52, an upper surface 53, a forward lower surface 54 which is flat or which may preferentially be lightly convex and a rearward lower surface 55 which is lightly convex at its forward end before becoming markedly concave. As shown in previous figures the section chord is $C_{SA}$ and the leading edge is submerged at a depth $d_{SR}$ below the static water level SWL. FIG. 9 shows the same section in the design condition in which it provides a very efficient planing surface. A spray root is generated at 58 and the surface at this point is arranged to have a small angle of attack $\beta_R$ relative to the dynamic water line DWL. The chord is reduced to $C_{DA}$ whereby the ratio of $C_{DA}/C_{SA}$ is arranged such that lift required at the intended speed for foilborne operation dictates the chord $C_{SA}$ whereas the design speed determines the value of $C_{SA}$. The requirements for mechanical strength, lift coefficient and lift/drag ratio for foilborne operation may also influence the values of $C_{SA}$ and $C_{DA}$. The rear hydrofoil may generally be arranged to be quite thick as the thickness is generally only limited by the cavity profile at speeds immediately below that required for planing operation. FIG. 10 shows a flapped variant in which a trailing edge flap is provided. The provision of such a flap will preferentially improve performance at low planing speeds by increasing the effective camber of the foil. The application of negative flap angles may preferentially be applied for very high speed operation. By reducing the effective camber the lift coefficient is reduced maintaining the chord $C_{DA}$ for efficient operation.

Figure 11:
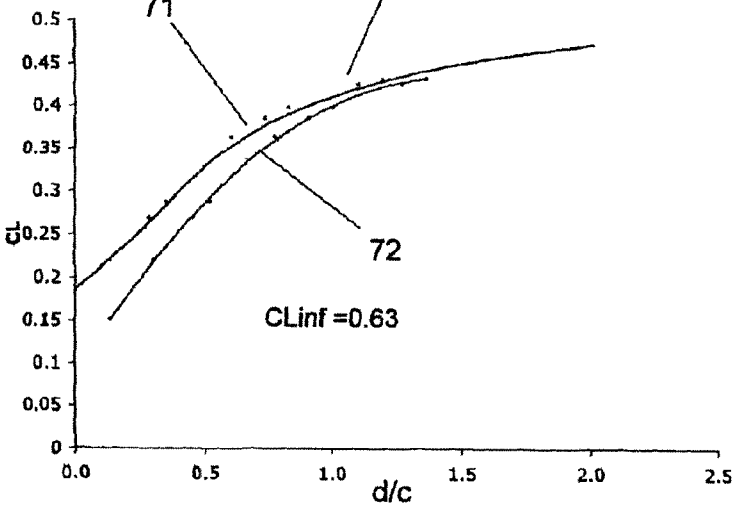
FIG. 11 shows the variation of the lift coefficient of typical sub-cavitating hydrofoil sections designed for operation at a depth below the water level operating at a constant angle of attack at varying depth of submergence.

Referring to FIG. 11 curves 7 show a rapid reduction in lift coefficient for sub-cavitating sections as the hydrofoil nears the water surface. Although not shown on this figure the lift/drag ration also falls away due to the an increasing effect of the friction drag. Initially this reduction is quite slow, but as the value of d/c approaches 0.25 the reduction in the lift/drag ratio becomes increasingly marked. Curve 71 shows the variance of the lift coefficient with the depth/chord ratio for an efficient hydrodynamic section with a slightly concave under surface. Curve 72 shows the variance for a more classic aerofoil section which a slightly convex under surface. The difference is due to the increasing reliance on the pressure distribution on the lower surface as a cavitation bubble increasingly grows on the upper surface which becomes fully ventilated at some point. Both sections have a 2D lift coefficient of 0.63 when deeply immersed.

Figure 12:
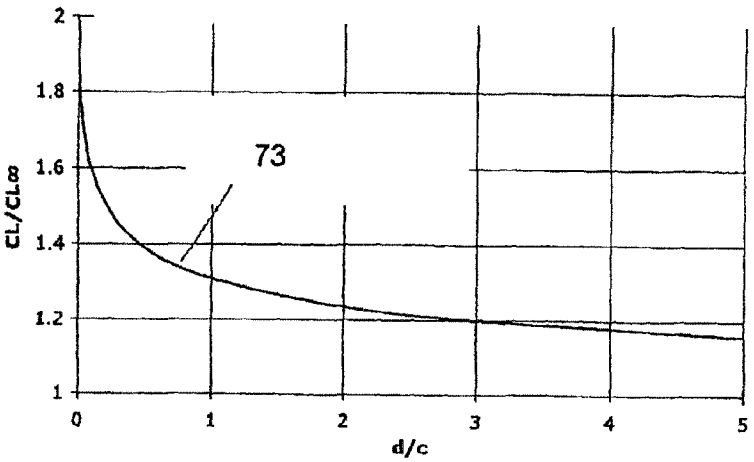
FIG. 12 shows the variation of the lift coefficient of cavitating hydrofoil section operating at a constant angle of attack at varying depth of submergence.

Referring to FIG. 12 the opposite effect is evident for cavitating sections. For the flat plate shown by curve 73 the lift coefficient doubles between deep immersion and zero immersion with most of this occurring when the hydrofoil is very close to the surface. The curve for more efficient cavitating sections follows the same trend although the overall increase in lift coefficient is reduced from 100% to generally 25% to 50%. The lift/drag ratio for a cavitating section tends to improve as the surface is approached. The frictionless value tends to be little changed but the friction coefficient has a reducing effect as the lift coefficient increases close to the surface.

It will be evident from FIGS. 11 and 12 that the design of a suitable section is highly dependent on the range of immersion depth intended, particularly if operation within the range of immersion depths between 0.5 and zero is expected.

Figure 13:
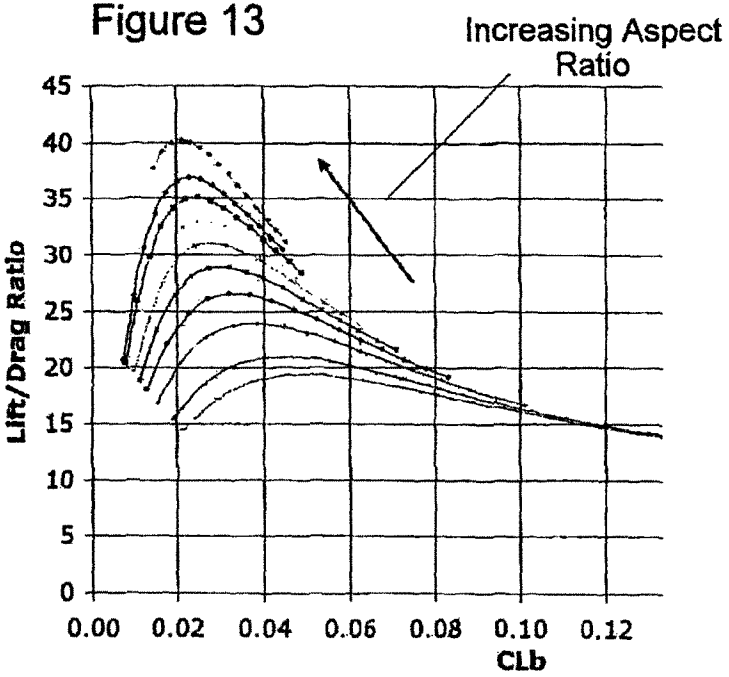
FIG. 13 shows the variation of the lift/drag ratios with the lift coefficient based on the span of the hydrofoil of planing hydrofoils of aspect ratios varying between 2.5 and 12 operating at a constant angle of attack and with varying camber.
Figure 14:
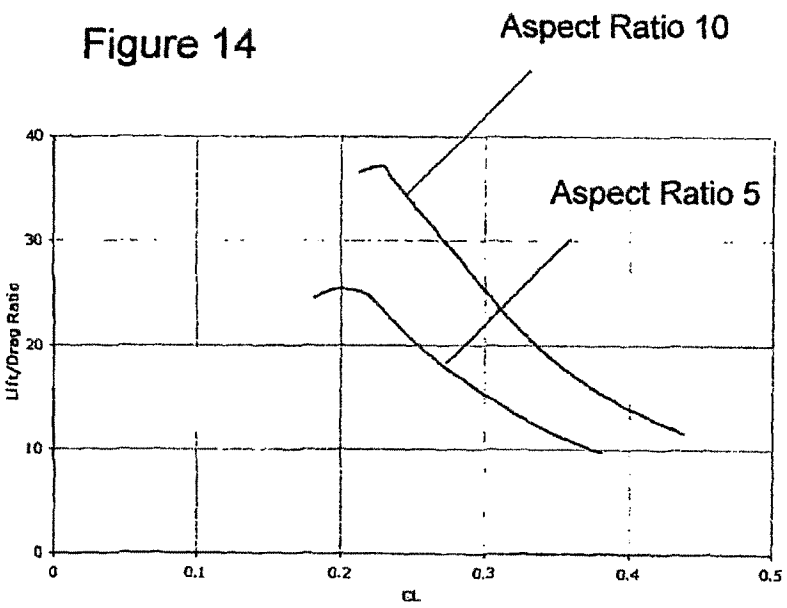
FIG. 14 shows the variation of the lift/drag ratios with the lift coefficient of planing hydrofoils of aspect ratios of 5 and 10 having constant section operating at varying angles of attack.

Referring to FIGS. 13 and 14 the benefit of using the constant span planing rear hydrofoil together with the aspect ratio enhancing attributes of the present invention is demonstrated. FIG. 13 shows the rapid improvement in the lift/drag ratio as the aspect ratio is improved. It also shows that the camber and associated value of the lift coefficient based on span must be carefully selected to lie within a desired range of lift/drag values. FIG. 14 shows values of CL and the lift/drag ratio for hydrofoils having aspect ratios or 5 and 10 with the same section with the lift coefficient varied by changing the angle of attack. These curves show the importance of maintaining an optimum angle of attack with the performance dropping away rapidly as the angle of attack is increased. The aspect ratio is equally of key importance. The features resulting in a high aspect ratio for a defined beam have been described above.

Whilst the slope of the lift coefficient curve and the depth of immersion of the from hydrofoil gives a measure of passive regulation of the craft ride height and trim angle, this regulation is not sufficient to ensure the maintenance of an optimum angle of attack for the rear hydrofoil 5, especially if a wide range of load and LCG conditions prevail. The preferred use of a front foil 4 with flaps 43 enables such precision control.

Figure 15:
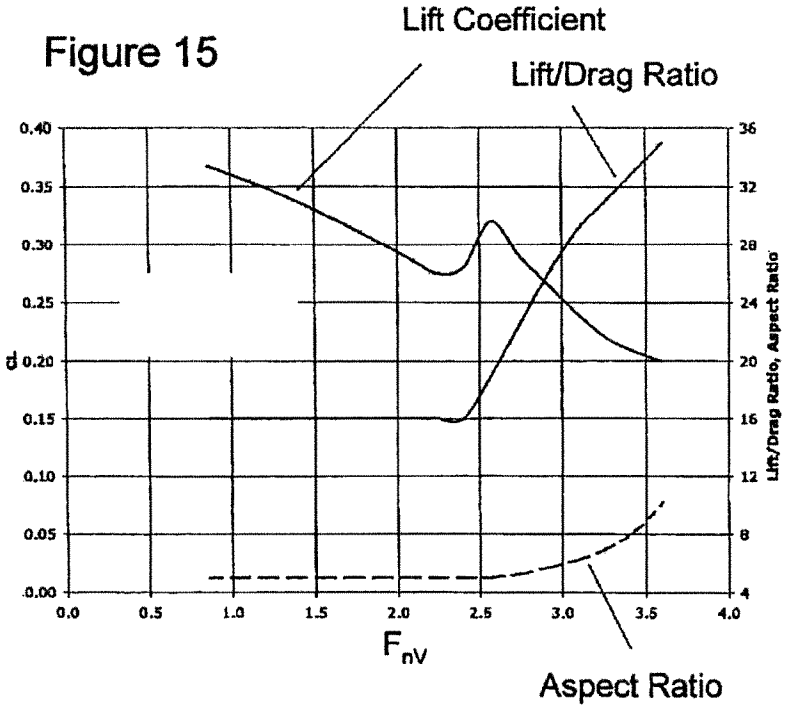
FIG. 15 shows the variation of the lift/drag ratios with the lift coefficient of planing hydrofoils of aspect ratios of 5 and 10 having constant section operating at varying angles of attack.
Figure 16:
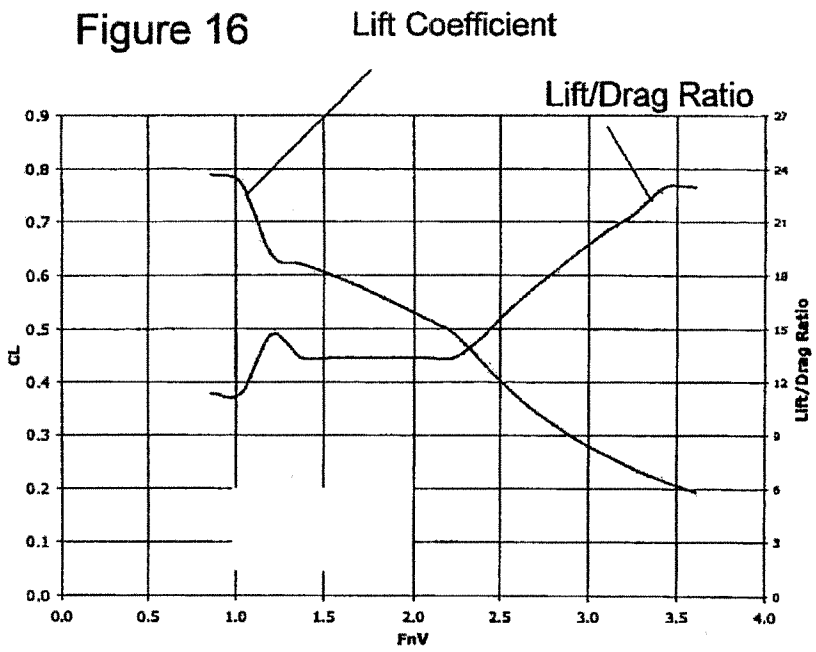
FIG. 16 shows the variation of the lift coefficient and the lift/drag ratio for a flapped front foil of the present invention with varying displacement Froude no ($F_{nv}$)
Figure 17:
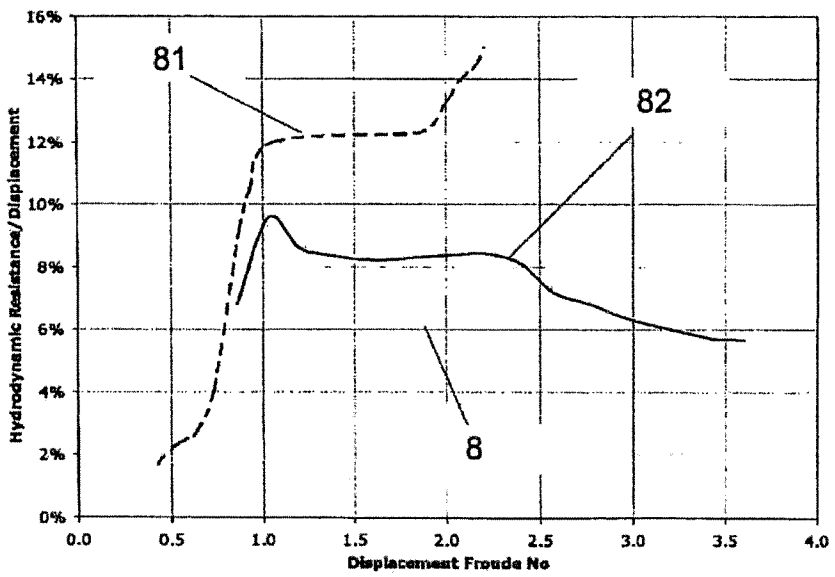
FIG. 17 shows the variation of the hydrodynamic resistance to displacement ratio for a typical semi-displacement catamaran and for the same hull fitted with the flapped front and non-flapped planing rear hydrofoils of the present invention with varying displacement Froude no ($F_{nv}$)

The performance effects of the present invention can be seen by reference to FIGS. 15, 16 and 17. FIG. 15 shows the performance values for the rear foil 5 under a particular load condition. The lift coefficient initially drops away as the hydrofoil immersion reduces reaching a minimum value at a displacement Froude displacement number of about 2.4. As the speed increases the lift coefficient rises rapidly as the foil reaches the surface. The foil becomes fully planing at a displacement Froude number of 2.6. Thereafter the lift coefficient decreases due to a decreasing angle of attack, although the value may be beneficially adjusted to reduce the wetted area faster. The lift/drag ratio initially remains relatively constant but increases abruptly as the foil becomes very close to the surface, continuing to rise as the aspect ratio increases and the angle of attack decreases. The aspect ratio increases progressively after the hydrofoil becomes fully planing.

FIG. 16 shows the values of CL and the lift/drag ratio for the front foil 4 under the same load conditions. In this case the flap angle is stabilised at a displacement Froude number of about 13. Thereafter the C1 values falls away as the immersion depth reduces. At about a displacement Froude No of 2.2 the hydrofoil is supporting its design load and the flap angle reduces progressively as the required CL reduces. The lift/drag ratio remains relatively constant whilst the flap angle remains high and progressively increases as the flap angle reduces Curves 8 of FIG. 17 shows the resistance/displacement ratio against displacement Froude number of a basic catamaran craft with and without the addition of hydrofoils according to the present invention. Curve 81 shows the resistance of the standard craft in which an initial resistance plateau is reached at a displacement Froude number of about 1.0. The resistance then rises sharply above a displacement Froude number of 1.8. Curve 82 shows the performance of the same craft fitted with an active flapped front foil and fixed planing rear foil according to the present invention. Compared to the standard craft the resistance starts to reduce from a displacement Froude number as low as about 0.8 before peaking at a lower value than that achieved with a standard craft. After the peak the resistance reaches a plateau at about ⅔ of the value of the standard craft before falling away steadily from above a displacement Froude number of 2.4 due to the combined performance improvements of the front and rear hydrofoils.

The invention claimed is:

1. A marine catamaran craft, comprising catamaran hulls, at least one forward hydrofoil fixed to each of the catamaran hulls and at least one rear hydrofoil in which:

the rear hydrofoil has a leading edge and a trailing edge, and an upper surface and a lower surface extending between the leading and trailing edges, the at least one forward hydrofoil is arranged for shallowly submerged operation at both low speeds below a design speed of the craft, and at higher speeds above the design speed;

the at least one rear hydrofoil is arranged for shallowly submerged operation at low speeds below the design speed and for planing operation at higher speeds above the design speed, wherein at speeds above the design speed;

the hull is configured to adopt a trim angle such that the aft ends of the hulls are submerged and the forward ends of the hulls are above the water surface, and the rear hydrofoil is configured to provide, in planing operation, a spray root edge on the lower surface aft of the leading edge, such that a wetted area of the lower surface aft of the spray root edge acts as a planing surface that is less than a physical area of the lower surface of the rear hydrofoil.

2. A craft as in claim 1 wherein the at least one forward hydrofoil comprises a horizontal lifting surface and generally vertical tip sections for attachment to the catamaran hulls.

3. A craft as in claim 1 wherein the at least one forward hydrofoil comprises dihedral lifting surfaces and generally vertical tip sections for attachment to the catamaran hulls.

4. A craft as in claim 2 in which the generally vertical tip sections for attachment to the catamaran hulls are arranged at an angle of attack such as to optimise the pressure distribution along the forward hydrofoil.

5. A craft as in claim 1 in which the generally vertical forward foil tip sections are attached to a surface of the catamaran hulls such as to provide an effective tip fence at speeds at which such hull attachment areas are wetted.

6. A craft as in claim 1 wherein the at least one rear hydrofoil has a section profile arranged such that the chord diminishes with increasing speed above the speed above which the hydrofoil becomes fully planing.

7. A craft as in claim 1 wherein the at least one rear hydrofoil has a lower surface which blends into the rear part of the catamaran hulls which remain wetted.

8. A craft as in claim 1 in which any of the rear parts of the catamaran hulls which remain wetted comprise an intake for a waterjet propulsion system.

9. A craft as in claim 1 in which any of the rear parts of the catamaran hulls which remain wetted comprise a transom interceptor.

10. A craft as in claim 1 in which any of the rear parts of the catamaran hulls which remain wetted comprise a transom flap.

11. A craft as in claim 1 in which any of the rear parts of the catamaran hulls which remain wetted comprise a transom wedge.

12. A craft as in claim 1 wherein the at least one forward hydrofoil comprises one or more adjustable flaps.

13. A craft as in claim 1 wherein the at least one forward hydrofoil comprises one or more controllable flaps and a control system.

14. A craft as in claim 1 wherein the at least one rear hydrofoil comprises one or more flaps which are adjustable.

15. A craft as in claim 1 wherein the at least one rear hydrofoil comprises one or more flaps which are controllable and which comprise a control system.

16. A craft as in claim 3 in which the generally vertical tip sections for attachment to the catamaran hulls are arranged at an angle of attack such as to optimise the pressure distribution along the forward hydrofoil.

17. A craft as in claim 1 in which the lower surface of the rear hydrofoil has a forward lower surface that is flat or lightly convex, and a rearward lower surface that is lightly convex at its forward end before becoming markedly concave.

18. A craft as in claim 17 in which the lower surface has a chord direction extending between the leading and tailing edges, wherein the lower surface has a wetted chord length at low speeds below the design speed which is equal to the distance between the leading and trailing edges, and a reduced wetted chord length in the planing operation that is defined by a distance between the spray root edge and the trailing edge.

* * * * *